US006865856B2

(12) United States Patent
Kim et al.

(10) Patent No.: US 6,865,856 B2
(45) Date of Patent: Mar. 15, 2005

(54) PLASTIC FLOORINGS USING CONCAVE PORTIONS AND CONVEX PORTIONS

(75) Inventors: Young-Gi Kim, Cheongju (KR); Sung-Chan Park, Seoul (KR); Han-Chul Jang, Kyungki-do (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 10/450,729

(22) PCT Filed: Dec. 14, 2001

(86) PCT No.: PCT/KR01/02179

§ 371 (c)(1),
(2), (4) Date: Jun. 13, 2003

(87) PCT Pub. No.: WO02/47905

PCT Pub. Date: Jun. 20, 2002

(65) Prior Publication Data

US 2004/0045247 A1 Mar. 11, 2004

(30) Foreign Application Priority Data

Dec. 14, 2000 (KR) ..... 2000-76354
Dec. 13, 2001 (KR) ..... 2001-79101

(51) Int. Cl.[7] ..... E04B 2/18; E04B 2/32; E04B 2/46

(52) U.S. Cl. ..... 52/592.1; 52/592.4; 52/590; 52/387; 52/392; 52/578

(58) Field of Search ..... 52/387, 392, 590.3, 52/592.1–592.4, 578, 581, 582.1, 590.1, 589.1, 590.2–592.6

(56) References Cited

U.S. PATENT DOCUMENTS 3,200,553 A * 8/1965 Frashour et al. ..... 52/592.4
3,347,048 A * 10/1967 Brown et al. ..... 405/16
3,640,191 A * 2/1972 Hendrich ..... 404/41
5,904,021 A * 5/1999 Fisher ..... 52/578
6,053,661 A * 4/2000 Lewis ..... 405/36
6,272,808 B1 * 8/2001 Groh et al. ..... 52/592.1
6,324,809 B1 * 12/2001 Nelson ..... 52/592.2
6,345,481 B1 * 2/2002 Nelson ..... 52/592.2
6,682,254 B1 * 1/2004 Olofsson et al. ..... 403/375
6,684,592 B2 * 2/2004 Martin ..... 52/591.5
6,715,253 B2 * 4/2004 Pervan ..... 52/578

FOREIGN PATENT DOCUMENTS

JP 06-101329 A 4/1994
JP 2000-296260 A 10/2000
WO WO 00/47841 8/2000

* cited by examiner

*Primary Examiner*—Jeanette Chapman
(74) *Attorney, Agent, or Firm*—Alston & Bird LLP

(57) ABSTRACT

The present invention relates to a new plastic flooring that is assembled by concave portions and convex portions. The plastic flooring provides space between the concave portions and convex portions. The space absorbs the heat expansion of the plastic flooring such that the deformation of the plastic flooring is prevented. Also, the space stores an adhesive on a bottom floor such that crevices between the plastic flooring are prevented.

13 Claims, 5 Drawing Sheets

PLASTIC FLOORINGS USING CONCAVE PORTIONS AND CONVEX PORTIONS

BACKGROUND OF THE INVENTION (a) Field of the Invention

The present invention relates to plastic floorings using concave portions and convex portions, specifically to an assembly structure of the plastic floorings absorbing heat expansions as well as forming a space area between the concave portions and the convex portions to minimize the deformation of the plastic floorings so that alien substances of a floor surface does not protrude up to the surface of the floorings.

(b) Related Arts

Plastic floorings used for installing floors of a building are individually manufactured so that they have a surface area of a certain standard. The plastic floorings are used with other types of plastic floorings to constitute the floors of the building. Typical plastic floorings mostly have a form of a square shape having perpendicular corners and a certain thickness. At the side surfaces of each flooring, unique assembly structures are implemented which allow them to be assemble with other types of floorings.

FIG. 8 is a cross section view of plastic floorings according to a prior art in which each plastic floorings (1) has steps in a form of stairs connected to other plastic floorings (1') so that multiple floorings (1, 1') are assembled in a continuous overlapping manner.

Above assembly structures, however, have the shortcomings of having a height difference between the floorings when the floor to which the floorings are installed is bumpy because the floorings do not closely and firmly adjoin each other in the area connecting the floorings.

Therefore, plastic floorings (3) having concave portions (5) and convex portions (7) on the side surfaces of each flooring (3) as illustrated in FIG. 9 have been proposed to closely adjoin the connecting areas of the floorings.

That is, the plastic flooring (3) has the convex portion (7) at the left side of the drawing and concave portion (5) at the right side of the drawing. The assembly of the floorings (3, 3') is enabled by inserting the convex portion (7) into the concave portion (5) of the other plastic floorings (3') and engaging the concave portion (5) with the convex portion (7) of the other plastic floorings (3').

In floorings (3) with such a structure, however, the concave portions (5) and the convex portions (7) engage in a close manner so that when the heat from the bottom surface is transferred to the plastic flooring, each plastic flooring expands toward the other plastic flooring adjacent to it. As a result, distortion in the connection portion of the flooring (3) occurs as can seen in FIG. 10, which seriously degrades the quality of the floorings.

Furthermore, many alien substances such as adhesives exist on the bottom floor (9) to which the floorings (3) are installed. After the installation, the alien substances (3) protrude beyond the connection portions, exposing itself out on the surface of the floorings. These alien substances weaken the adjoining force between the concave portion (5) and the convex portion (7), which causes the problem of deteriorating adjoining force among the floorings.

SUMMARY OF THE INVENTION

An object of the present invention is to provide an assembly structure of plastic floorings using concave portions and convex portions which absorb the heat expansion of the floorings as well as preventing alien substances of bottom surface from protruding onto the flooring surface so as to minimize the distortion of the plastic floorings.

In order to achieve this object, the present invention comprises; a first flooring having a first side surface with a concave portion and a second side surface with a convex portion, and a second flooring assembled to the side surface of the first flooring through an engagement of the convex portions and the concave portions, said concave portion and the convex portions\forming abutting surfaces engaging each other in a close manner and at least one facing surface disposed so that they face each other and have gaps in between, providing a heat expansion tolerance portion between the concave portion and the convex portion.

DETAILED DESCRIPTION AND THE PREFERRED EMBODIMENTS

Hereinafter, preferred embodiments of the present invention will be explained in detail with reference to the drawings.

Figure 1:
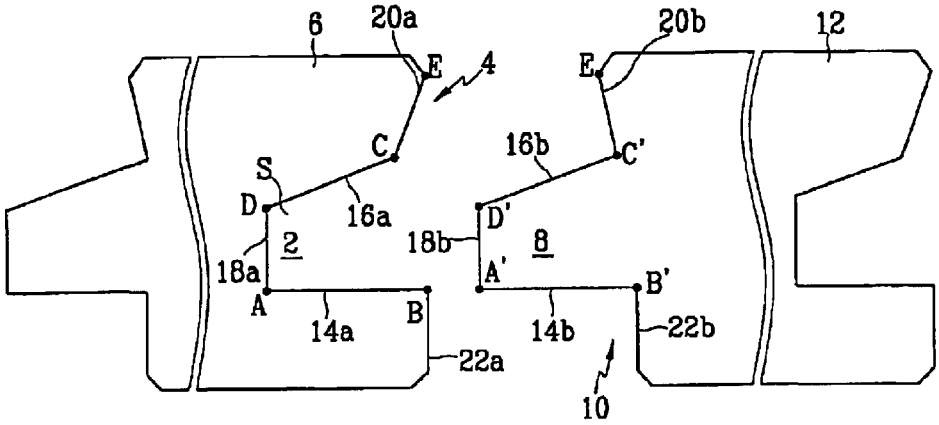
FIG. 1 is a cross section view of a plastic flooring according to the present invention.
Figure 2:
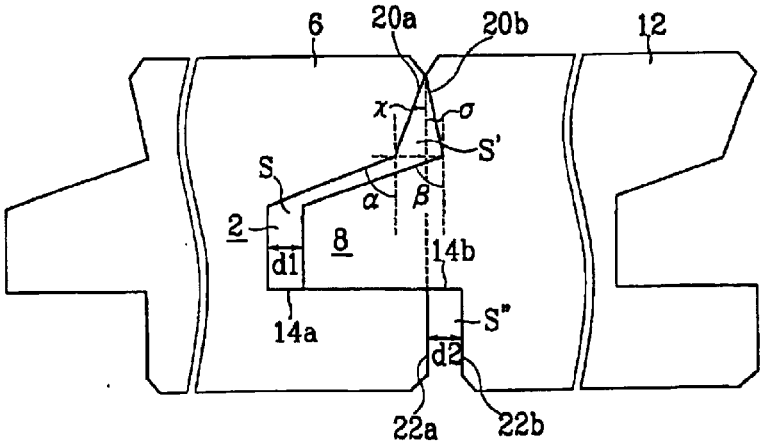
FIG. 2 is a detailed view of the plastic flooring according to the present invention in an assembled state.
Figure 3:
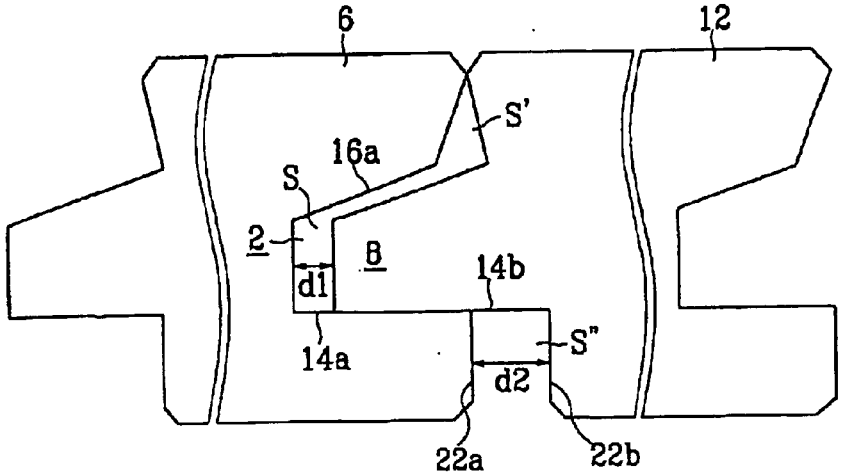
FIG. 3 is a cross section view of the plastic flooring according to another embodiment.

FIG. 1 is a cross section view of the plastic flooring according to the present invention. FIG. 2 is a drawing depicting the assembled plastic flooring of FIG. 1.

As illustrated in FIGS. 1 and 2, the plastic flooring comprises first flooring (6) having a first side surface (4) with a concave portion (2) and a second side surface (10) having a convex portion (8). Second flooring (12) is assembled with the first flooring (6) through an engagement of the concave portion (2) and the convex portion (8).

The concave portion (2) and the convex portion (8) form abutting surfaces (14*a*, 14*b*) closely engaging each other so that the first flooring (6) and the second flooring (12) are firmly assembled. Also, a pair of facing surfaces (16*a*, 16*b*, 18*a* and 18*b*), disposed with gaps in between, are formed so that a heat expansion tolerance portion S is provided between the concave portion (2) and the convex portion (8).

First, the first flooring (6) and the second flooring (12) have flat upper surfaces. The closely abutting surfaces (14*a*, 14*b*) formed on the concave portion (2) and the convex portion (8) are disposed so that they are parallel to the upper surface of the first flooring (6) and the second flooring (12). More specifically, the closely abutting surface (14*a*) of the concave portion (2) is defined as a surface starting from point A of the drawing, extending to point B. The closely abutting surface (14*b*) of the convex portion 8 is defined as a surface starting from point A' of the drawing, extending to point B'.

Here, the height of the closely abutting surface (14*b*) of the convex portion (8) with respect to the lower surface of the first flooring (6) and the second flooring (12) is in fact higher than the height of the closely abutting surface (14*a*) of the concave portion (2) with respect to the lower surface of the first flooring (5) and the second flooring (12) so that the closely abutting surface (14*b*) of the convex portion (8) comes into contact on the closely abutting surface (14*a*) of the concave portion (4) when the first flooring (6) and the second flooring (12) are assembled.

Consequently, the connecting portions of the first flooring (6) and the second flooring (12) abut closely and firmly through the closely abutting surfaces (14*a*, 14*b*) provided at the concave portion (2) and the convex portion (8). Thus, even when the floor surface (not shown) is bumpy, the height difference between the first flooring (6) and the second flooring (12) due to the bumps are suppressed.

Also, the facing surfaces formed at the concave portion (2) and the convex portion (8) consist of the slanted surfaces (16*a*, 16*b*) maintaining a certain angle with the upper surface of the first flooring (6) and the second flooring (12) and perpendicular surfaces (18*a*, 18*b*) connecting the slanted surfaces (16*a*, 16*b*) with each closely abutting surface (14*a*, 14*b*). The slanted surface (16*a*) and the perpendicular surface (18*a*) formed at the concave portion (2) maintain a certain gap with the slanted surface (16*b*) and the perpendicular surface (18*b*) formed on the convex portion (8), thereby providing space between the concave portion (2) and the convex portion (8).

More specifically, the slanted surface (16*a*) of the concave portion (2) is defined as a surface starting from point C of the drawing, extending to point D of the drawing. The slanted surface (16*b*) of the convex portion (8) is defined as a surface starting from point C' of the drawing, extending to point D' of the drawing. Also, the perpendicular surface (18*a*) of the concave portion (2) is defined as a surface starting from point D of the drawing, extending to point A of the drawing. The perpendicular surface (18*b*) of the convex portion (8) is defined as a surface starting from point D' of the drawing, extending to point A' of the drawing.

Particularly, the perpendicular surfaces (18*a*, 18*b*) of the concave portion (2) and the convex portion (8) face each other with a gap of d1 in between. The slanted surfaces (16*a*, 16*b*) of the concave portion (2) and the convex portion (8) maintain angles of $\alpha$ and $\beta$ with respect to a virtual normal perpendicular to the upper surface of the first flooring (6) and the second flooring (12). $\alpha$ and $\beta$ are configured so that the following conditions are met.

[Mathematical Formula]

$$\alpha=65\sim75^\circ,\ \beta=65\sim75^\circ,\ \alpha\geqq\beta$$

Above conditions are necessary to facilitate the engagement between the concave portion (2) and the convex portion (8). If $\alpha$ is smaller than $\beta$, the insertion of the convex portion (8) into the concave portion (2) is not smooth, which causes such problems as fracture in the convex portion (8) during the assembly of the first flooring (6) and the second flooring (12).

In this manner, the structure of the concave portion (2) and the convex portion (8) forms a space, that is, a heat expansion tolerance portion (S), between the concave portion (2) and the convex portion (8). The heat expansion tolerance portion (S) absorbs the heat expansion of the first flooring (6) and the second flooring (12) when the first flooring (6) and the second flooring (12) heat expands from the heat of the bottom surface, allowing the assembled floorings to maintain a flat shape, consequently, preventing the deformation of the floorings.

Furthermore, the heat expansion tolerance portion (S) traps the alien substances such as adhesives on the floor surface within its interior, effectively preventing the phenomena of the alien substances protruding on to the surface of the first flooring (6) and the second flooring (12) as well as formation of crevice of the first and second floorings (6, 12) by the alien substances.

On the other hand, the first flooring 6 and the second flooring (12) forms an additional heat expansion tolerance portion (S') between the first side surface (4) with the concave portion (2) and the second side surface (10) with convex portion (8) as well as the heat expansion tolerance portion (S) formed by the concave portion (2) and the convex portion (8) of the first and the second floorings (6, 12). The additional heat expansion tolerance portion (S') supplements the function of absorbing the heat expansion of the flooring and prevention of the crevices.

For such purposes, the first side surface (4) provides a supplemental slanted surface (20*a*) starting from the upper surface of the first flooring (6) extending toward the interior of the first flooring (6) and connected to the slanted surface (16*a*) of the concave portion (2). The second side surface (10) provides a supplemental slanted surface (20*b*) starting from the upper surface of the second flooring (12) extending toward the interior of the second flooring (12) and connected to the slanted surface (16*b*) of the convex portion (8). Thus, additional space, that is the heat expansion tolerance portion (S'), is formed between the supplemental slanted surfaces (20*a*, 20*b*).

More specifically, the supplemental slanted surface (20*a*) of the first side surface (4) is configured as a surface having an angle of $\chi$ with respect to a virtual normal, starting from point E and extending to point C of the drawing. The supplemental slanted surface (20*b*) of the second side surface (10) is configured as a surface having an angle of $\delta$ with respect to a virtual normal, starting from point E and extending to C' of the drawing.

Preferable, $\chi$ and $\delta$ satisfy the following conditions.

[Mathematical Formula 2]

$$\chi=0\sim8^\circ,\ \delta=0\sim8^\circ,\ \chi\geqq\delta,\ \chi+\delta=0\sim16^\circ$$

These conditions are for absorbing the heat expansion of the floorings by forming sufficient heat expansion tolerance portion (S') between the first side surface (4) and the second side surface (10) while enabling the holding of the aliens substances therein. If $\chi+\delta$ is set below 0°, then the heat expansion tolerance portion cannot perform its function whereas if the $\chi+\delta$ is set above 16°, then the strength of the first and the second floorings (6, 12) decreases because of the excessive heat expansion tolerance portion so that problems such as fracturing at the corners occur when the floorings are subject to pressure.

Furthermore, the first side surface (4) provides a perpendicular surface (22*a*) connected to the closely abutting surface (14*a*) of the concave portion (2) at the lower surface of the first flooring (6). The second side surface (10) provides a perpendicular surface (22*b*) connected to the closely abutting surface (14*b*) of the convex portion (8) at the lower surface of the second flooring (12). The perpendicular surfaces (22*a*, 22*b*) of the first and the second side surfaces (4, 10) maintain a gap of d2 between each other, forming a heat expansion tolerance portion (S").

The heat expansion tolerance portion (S") defined by the gap d2 contacts the floor surface directly. Therefore, it absorbs the heat expansion which occurs when the lower surfaces of the first and the second floorings (6, 12) expand because of the heat from the bottom floor as well as directly holding alien substances existing on the bottom floor so that the alien substances do not protrude beyond the closely abutting surface (14*a*) and (14*b*) of the concave portion (2) and the convex portion (8).

Therefore, it is preferable to configure the heat expansion tolerance portion (S") as identical to above d1 or satisfy the following conditions considering the heat applied to the floorings and the condition of the flooring surfaces to which the floorings are being installed.

[Mathematical Formula 3]

$$d2=2\times d1$$

In these plastic floorings according to the present embodiment, the connecting portions of the first and the second floorings (6, 12) are firmly and closely abutted by the engagement of the closely abutting surfaces (14*a*, 14*b*) of the concave portion (2) and the convex portion (8) while the heat expansion tolerance portions (S, S' and S") absorb the heat expansion of the floorings and holds the alien substances of the floor surface, providing the merit of preventing the deformation of the floorings caused by the heat expansion and the alien substances.

Here, when the thickness of the floorings is assumed to be 1, preferable configurations are as follows: the thickness from the upper surface of the first and the second floorings (6, 12) to the slanted surface (14*a*, 14*b*) of the concave portion (2) and the convex portion (8) is ¼, the thickness of the slanted surface (16*a*, 16*b*) of the concave portion (2) and the convex portion (8) is ¼, the thickness of the perpendicular surface (18*a*, 18*b*) of the concave portion (2) and the convex portion (8) is ¼, and the thickness from the closely abutting surface (14*a*, 14*b*) of the concave portion (2) and the convex portion (8) to the lower surface of the first and the second floorings (6) and (12) is ¼.

On the other hand, the plastic floorings according to the present invention can be assembled in the following manner using the engagement structure of the concave portion (2) and the convex portion (8).

Figure 4:
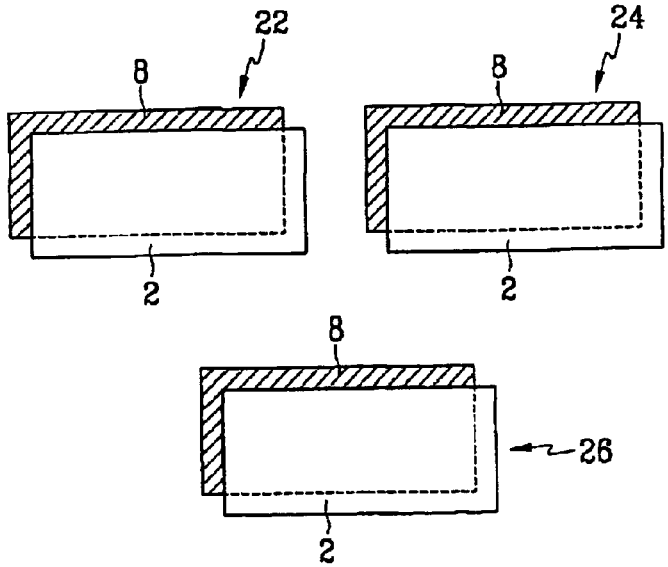
FIGS. 4 to 6 are schematic drawings explaining the manner of assembling the plastic flooring according to the present invention.

First, as shown in FIG. 4, the concave portions (2) are formed at the two adjacent side surfaces and the convex portions (8) are formed on the remaining two other side surfaces of each plastic flooring. The convex portion (8) of the second flooring (24) is assembled by fitting it into the concave portion (2) of the first flooring (22). The convex portion (8) of the third flooring (26) is assembled by fitting it into the concave portion (2) of the first and the second floorings (22, 24).

Figure 5:
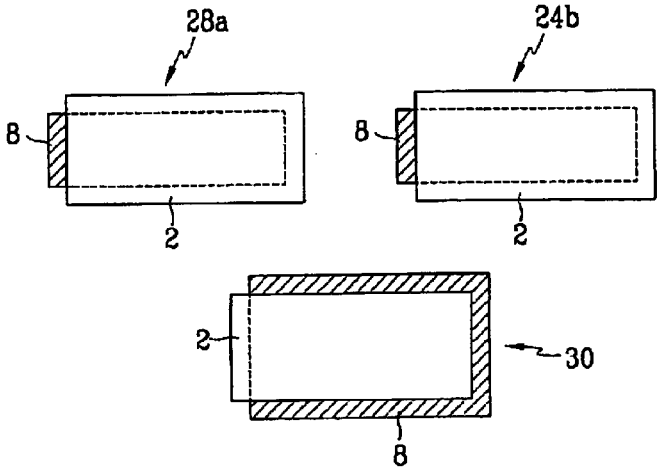

As another embodiment, a first group of plastic flooring (28*a*, 28*b*) has the structure having the concave portions at three adjacent side surfaces and having convex portion (8) at remaining one side surface as shown in FIG. 5. A second group of plastic floorings (30) has the structure of having the convex portions (8) at three adjacent side surfaces and the concave portion (2) at one remaining side surface.

To the concave portions (2) of the first flooring (28*a*) belonging to the first group, the convex portions (8) of the second floorings (28*b*) are assembled in one direction. To the side surface of the plastic floorings (28*a*, 28*b*) belonging to the first group, the plastic floorings (30) of the second group are connected and assembled.

Figure 6:
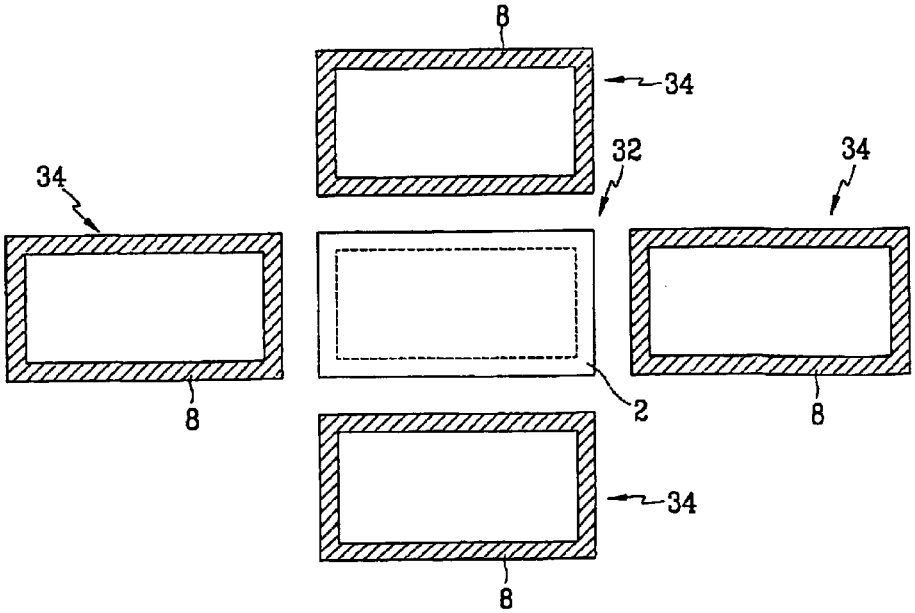

In still another embodiment as shown in FIG. 6, the plastic flooring (32) of the first group has the concave portions (2) formed at all four side surfaces whereas the plastic flooring (34) of the second group has the convex portions (8) formed on all four side surfaces. At all four side surfaces of the plastic flooring (32) belonging to the first group, the plastic floorings (34) of the second group are connected and assembled.

Figure 7:
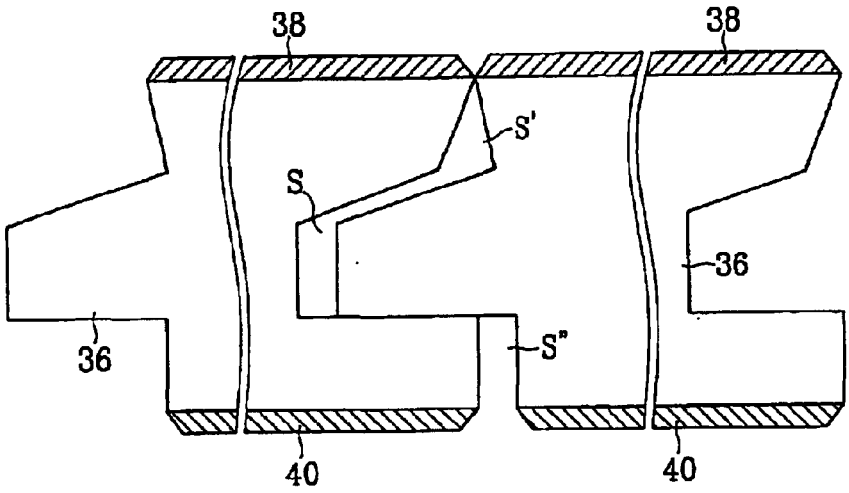
FIG. 7 is a cross section view of the plastic flooring according to another embodiment of the present invention.
Figure 8:
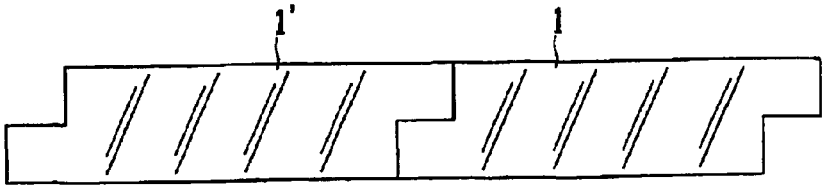
FIG. 8 is a cross section view of the plastic flooring according to a prior art.
Figure 9:
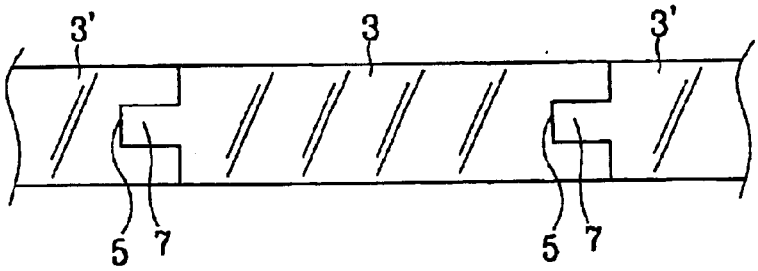
FIG. 9 is a cross section view of the plastic flooring according to another prior art.
Figure 10:
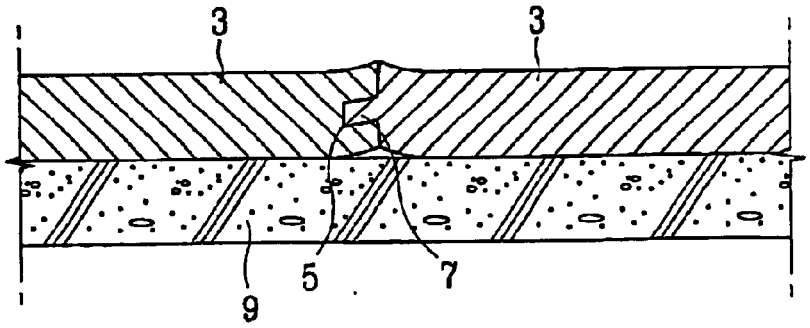
FIG. 10 is a schematic drawing explaining the distortion phenomenon of the plastic floorings.

The plastic flooring assembled in these manners can be formed wholly of plastic while it can also comprise a substrate layer (36) and a surface layer (38) located above the upper surface of the substrate layer (36) attributing pattern to the floorings, and a balance layer (40) which prevents the contraction and expansion of the flooring and maintaining the flatness as shown in FIG. 7.

For example, the surface layer (38) can be of natural material of a patterned wood layer and the balance layer (40) is a glass fiber impregnated with plastic. The plastic floorings can establish the dimension stability by the balance layer (40).

Preferably, the corners of the surface layer (38) and the balance layer (40) are beveled so that the beveled portion along with the heat expansion tolerance portion (S) absorb the heat expansion of the plastic flooring caused by the heat from the bottom surface; thus, preventing the occurrence of the height difference between the floorings.

According to the present invention, the formation of the heat expansion tolerance portion (S) between the concave portion (2) and the convex portion (8) has the effect of minimizing the deformation of the plastic floorings by absorbing the heat expansion of the floorings and preventing the alien substances of the bottom floor from protruding up to the surface of the floorings.

What is claimed is:

1. A plastic flooring comprising:

a first flooring having an upper surface, a lower surface, and a first side surface with a concave portion; and a second flooring having a flat upper surface, a lower surface, and a second side surface with a convex portion, said second flooring assembled to the side surface of the first flooring by inserting the convex portion into the concave portion, said concave portion and the convex portion each comprise, slanted surfaces formed on a top surface of the concave portion and the convex portion toward the upper surface of the first and the second floorings and maintaining a certain angle with respect to the upper surface of the first and the second floorings, abutting surfaces formed on a bottom surface of the concave portion and the convex portion toward the lower surface of the first and the second floorings and engaging each other in a close manner; and perpendicular surfaces connecting the slanted surfaces and the abutting surfaces, wherein the abutting surfaces of the concave portion and the convex portion being parallel to the upper surfaces of the first and the second floorings, and both of the slanted surface and the perpendicular surface of the concave portion being disposed facing with gaps between both of the slanted surface and the perpendicular surface of the convex portion so that a heat expansion tolerance portion is provided between the concave portion and the convex portion.

2. The plastic flooring of claim 1, wherein the slanted surface of the concave portion maintains an angle of $\alpha$ with respect to a normal perpendicular to the upper surface of the first flooring, and the slanted surface of the convex portion maintains an angle of β with respect to the normal, wherein the α and β satisfy the following conditions:

$$\alpha=65\sim75^\circ,\ \beta=65\sim75^\circ,\ \alpha\geqq\beta.$$

3. The plastic flooring of claim 1, wherein the first side surface provides a supplemental slanted surface starting from the upper surface of the first flooring toward interior of the first flooring and connected to the slanted surface of the concave portion, and the second side surface provides a supplemental slanted surface starting from the upper surface of the second flooring toward the interior of the second flooring and connected to the slanted surface of the convex portion so that a heat expansion tolerance portion is provided between the supplemental slanted surfaces of the first and the second side surfaces.

4. The plastic flooring of claim 3 wherein, the supplemental slanted surface of the first side surfaces maintains an angle of χ with respect to a normal perpendicular to the upper surface of the first flooring, and the supplemental slanted surface of the second side surfaces maintains an angle of δ with respect to the normal, wherein χ and δ satisfy the following conditions:

$$\chi=0\sim8^\circ,\ \delta=0\sim8^\circ,\ \chi\geqq\delta,\ \chi+\delta=0\sim16^\circ.$$

5. The plastic flooring of claim 1, wherein the first side surface provides a perpendicular surface connected to the abutting surface of the concave portion at the lower surface of the first flooring, and the second side surface provides a perpendicular surface connected to the abutting surface of the convex portion at the lower surface of the second flooring so that a heat expansion tolerance portion is provided between the perpendicular surfaces of the first and second side surfaces.

6. The plastic flooring of claim 5 wherein the gap d1 between the perpendicular surfaces formed on the first and the second side surfaces are identical to the gap d2 between the perpendicular surfaces formed between the concave portion and the convex portion.

7. The plastic flooring of claim 5, wherein the gap d1 between the perpendicular surfaces formed on the first and the second side surfaces is twice the gap d2 between the perpendicular surfaces formed on the concave portion and the convex portion.

8. The plastic flooring of claim 1, wherein the thickness starting from the upper surface of the first and the second floorings to the slanted surfaces of the concave portion and the convex portion, the thickness of the slanted surfaces of the concave portion and the convex portion, the thickness of the perpendicular surfaces of the convex portion and the concave portion, and the thickness starting from the abutting surfaces of the concave portion and the convex portion to the lower surface of the first and the second floorings are ¼ of the total thickness of the first and the second floorings.

9. The plastic flooring of claim 1, wherein the concave portions are formed on two adjacent sides of the plastic flooring and the convex portions are formed on the two remaining side surfaces.

10. The plastic flooring of claim 1, wherein the plastic floorings comprise a first group of floorings in which the concave portions are formed on three adjacent side surfaces and the convex portions are formed on one remaining side surface, and a second group of floorings in which the convex portions are formed on three adjacent side surfaces and the concave portions are formed on the remaining one side surface.

11. The plastic flooring of claim 1, wherein the plastic floorings include a first group of floorings in which the concave portions are formed on all four sides of the plastic flooring and a second group of floorings in which the convex portions are formed on all four side surfaces of the plastic flooring.

12. The plastic flooring of claim 1, wherein the first and the second floorings comprise, a substrate layer composed of plastic; a surface layer located at the upper surface of the substrate layer attributing pattern; and a balance layer located at the lower surface of the substrate layer attributing dimension stability.

13. The plastic flooring of claim 12 wherein the surface layer and the balance layer are beveled.

* * * * *